United States Patent [19]

McClintock

[11] 4,135,138

[45] Jan. 16, 1979

[54] ROTARY SOLENOID

[75] Inventor: Richard D. McClintock, Woodbury, Conn.

[73] Assignee: McClintock Manufacturing Corporation, Palisades Park, N.J.

[21] Appl. No.: 758,904

[22] Filed: Jan. 12, 1977

[51] Int. Cl.[2] ..... H01F 7/08

[52] U.S. Cl. ..... 335/272; 335/230

[58] Field of Search ..... 335/272, 229, 230 X, 335/225; 310/36

[56] References Cited

U.S. PATENT DOCUMENTS

| | | | |
|---|---|---|---|
| 2,966,106 | 12/1960 | Schackert | 335/272 |
| 3,229,711 | 1/1966 | Daugherty | 335/272 |
| 3,311,859 | 3/1967 | Bieger et al. | 335/230 |
| 3,636,557 | 1/1972 | Watkins | 335/272 |
| 3,694,782 | 9/1972 | Ray | 335/272 |

*Primary Examiner*—Harold Broome

*Attorney, Agent, or Firm*—Hubbell, Cohen, Stiefel & Gross

[57] ABSTRACT

A rotary solenoid comprises a housing, a rotor rotatably mounted in the housing, the rotor and the housing being comprised of a magnetically permeable material, and a solenoid coil mounted in the housing about the longitudinal axis thereof. The housing has at least a first pole piece portion therein with the rotor further comprising at least a first permanent magnet means mounted therein for simultaneous rotation therewith. The first permanent magnet means has first and second null positions with respect to the first pole piece and is mounted in the plane of the first pole piece for rotation about the longitudinal axis and provides a reverse magnetic flux in the housing and rotor magnetically permeable material. The solenoid coil has an energized state and a deenergized state with the rotor rotating a predetermined angular amount about the longitudinal axis from an initial position in response to a predetermined potential applied to the coil in the energized state. The first permanent magnet means has a pair of opposed sides substantially normal to the pole piece when adjacent thereto with one of the sides having an associated flux concentration which may differ from an associated flux concentration at the other opposed side of the permanent magnet means whereby the return torque curve of the solenoid may be varied.

16 Claims, 11 Drawing Figures

ROTARY SOLENOID

BACKGROUND OF THE INVENTION

1. Field of the Invention

The present invention relates to rotary solenoids.

2. Description of the Prior Art

Rotary solenoids are well known in the art. These conventional prior art rotary solenoids employ return springs on the return stroke of the solenoid to return the rotor to the initial rest position upon deenergization of the solenoid coil. However, the use of such a return spring reduces the forward torque present on the forward stroke of such rotary solenoids while, in addition, restricting reduction in size of such rotary solenoids because of the space necessary to accommodate the requisite return spring. Prior art attempts to improve the forward torque curve of the solenoid in the energized state have involved the use of a variable cam formed air gap in addition to the conventional return spring. However, the aformentioned disadvantages associated with the requisite return spring have not been overcome by such prior art arrangements. In addition, the magnetically permeable material forming the housing and rotor of prior art rotary solenoids undergoes normal aging over a period of time which aging produces undesirable effects, such as resultant sticking of the rotor due to residual magnetism present in the housing and rotor. In addition, prior art rotary solenoids, to applicant's knowledge, have not satisfactorily achieved optimum efficiency due to this failure to efficiently balance the factors of coil size and iron volume. Accordingly, the saturation flux density of the iron used in constructing the housing and rotor of such prior art devices is effectively limited by the associated saturation flux density of the material used. Thus, for a given housing size for such prior art rotary solenoids, there is a given maximum limit for the saturation flux density dependent on the material selected with the size of the housing effectively limiting the size of the coil. Moreover, as stated above, the coil size is effectively limited even further due to the necessity of providing space in the housing for the return spring. These disadvantages of the prior art are overcome by the present invention.

SUMMARY OF THE INVENTION

A rotary solenoid is provided which comprises a housing, a rotor rotatably mounted in the housing, the rotor and the housing being comprised of a magnetically permeable material, and a solenoid coil mounted in the housing about the longitudinal axis thereof. The solenoid does not include a return spring. Instead, the rotor has a shaft portion extending through the solenoid coil along the longitudinal axis and is rotatable within the solenoid coil, with the housing having at least a first pole piece portion and with the rotor further comprising a first permanent magnet means mounted therein for simultaneous rotation therewith. Of course, if desired, the permanent magnet may be in the housing and the pole piece may be in the rotor without departing from the spirit and scope of the present invention. The permanent magnet means has first and second null positions with respect to the pole piece and is mounted in the plane of the pole piece for rotation about the longitudinal axis, assuming the magnet is mounted in the rotor, in the plane between but not equal to the permanent magnet means null positions. The permanent magnet means provides a reverse magnetic flux in the housing and rotor magnetically permeable material. The solenoid coil has an energized state and a deenergized state with the rotor rotating a predetermined angular amount about the longitudinal axis from an initial position in response to a predetermined potential applied to the coil in the energized state, the permanent magnet means causing the rotor to rotate in a direction opposite to the predetermined direction to return the rotor to the initial position when the applied potential is removed from the coil to place the coil in a deenergized state. The rotor may comprise a plurality of spaced apart permanent magent means, such as a pair of substantially diametrically opposed permanent magnet means with the housing, in such instance, having an equal plurality of spaced apart pole piece portions mounted substantially in a common plane with the permanent magnet means. In such instance, the permanent magnet means all preferably have an associated equivalent magnetic polarity with respect to the pole pieces which may be either north or south. Most preferably, the permanent magnet means each have a pair of opposed sides substantially normal to the pole piece when adjacent thereto with one of the sides having an associated flux concentration which differs from an associated flux concentration at the other opposed side of the permanent magnet means, whereby the initial return torque as the permanent magnet means comes to rest at the initial position in a deenergized state is increased and the initial return torque when the coil is deenergized is decreased. The magnetically permeable material has an associated saturation flux density and, when the applied potential is sufficient to provide the saturation flux density in the energized state, a change in magnetic flux through the coil between a predetermined negative flux density value and a predetermined positive flux density value for the magnetically permeable material occurs between the deenergized state and the energized state of the coil thereby increasing the effective saturation flux density of the magnetically permeable material beyond the associated saturation flux density of the material. The housing also preferably comprises a cover portion disposed above the rotor in a plane substantially parallel to the aforementioned common plane with the cover portion having a slot therein. The rotor preferably has a protrusion extending therefrom into the slot for slidable movement therein with the protrusion being simultaneously rotatable with the rotor and slidable in the slot for providing a stop for the rotor rotation at the end points of the slot. The slot preferably has a predetermined extend between the end points thereof equivalent to the predetermined degree of rotation required for cooperation with the rotor protrusion for confining the rotor rotation about the longitudinal axis to between but not equal to the aforementioned null positions. The permanent magnet means are preferably arranged so as to overhang the respective pole pieces in the initial position for facilitating the rotation of the rotor in its predetermined direction in the energized state. If desired, any number of pole pieces and corresponding equal plurality of permanent magnets could be employed in the rotary solenoid of the present invention with the number employed being dependent on the length of the stroke desired since, the greater the number of magnets and pole pieces employed, the shorter the stroke. In addition, in the rotary solenoid of the present invention, if a coil voltage less than that required to provide the full cycle of rotation, such as determined by the extents of the slot in the cover, is provided, then the rotor will only partially rotate an amount dependent on this applied potential thereby enabling the degree of rotation of the rotor to be effectively controlled.

DETAILED DESCRIPTION OF THE PREFERRED EMBODIMENTS

Figure 1:
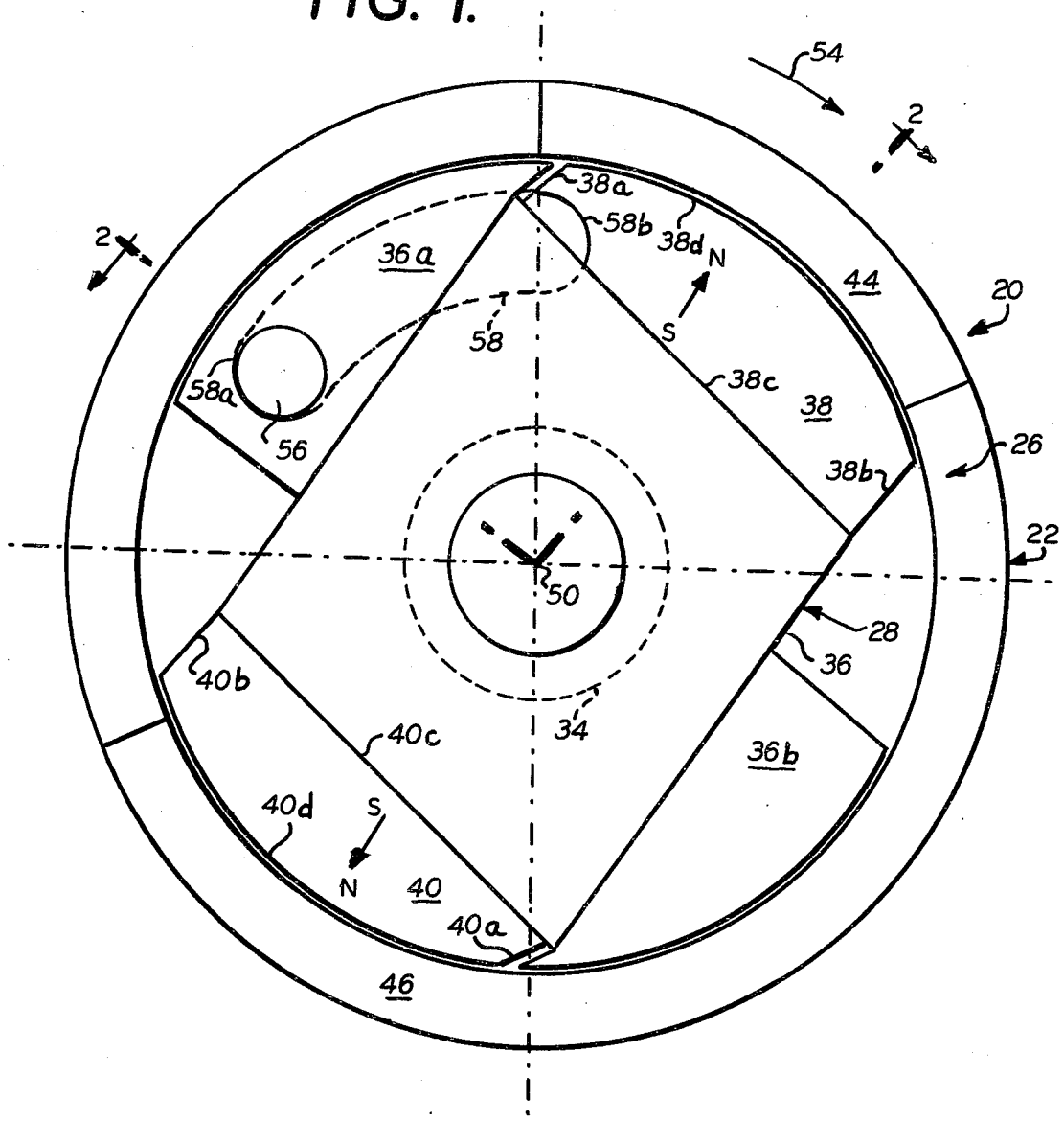
FIG. 1 is a top plan view, with the cover portion removed, of the presently preferred embodiment of the rotary solenoid of the present invention.
Figure 2:
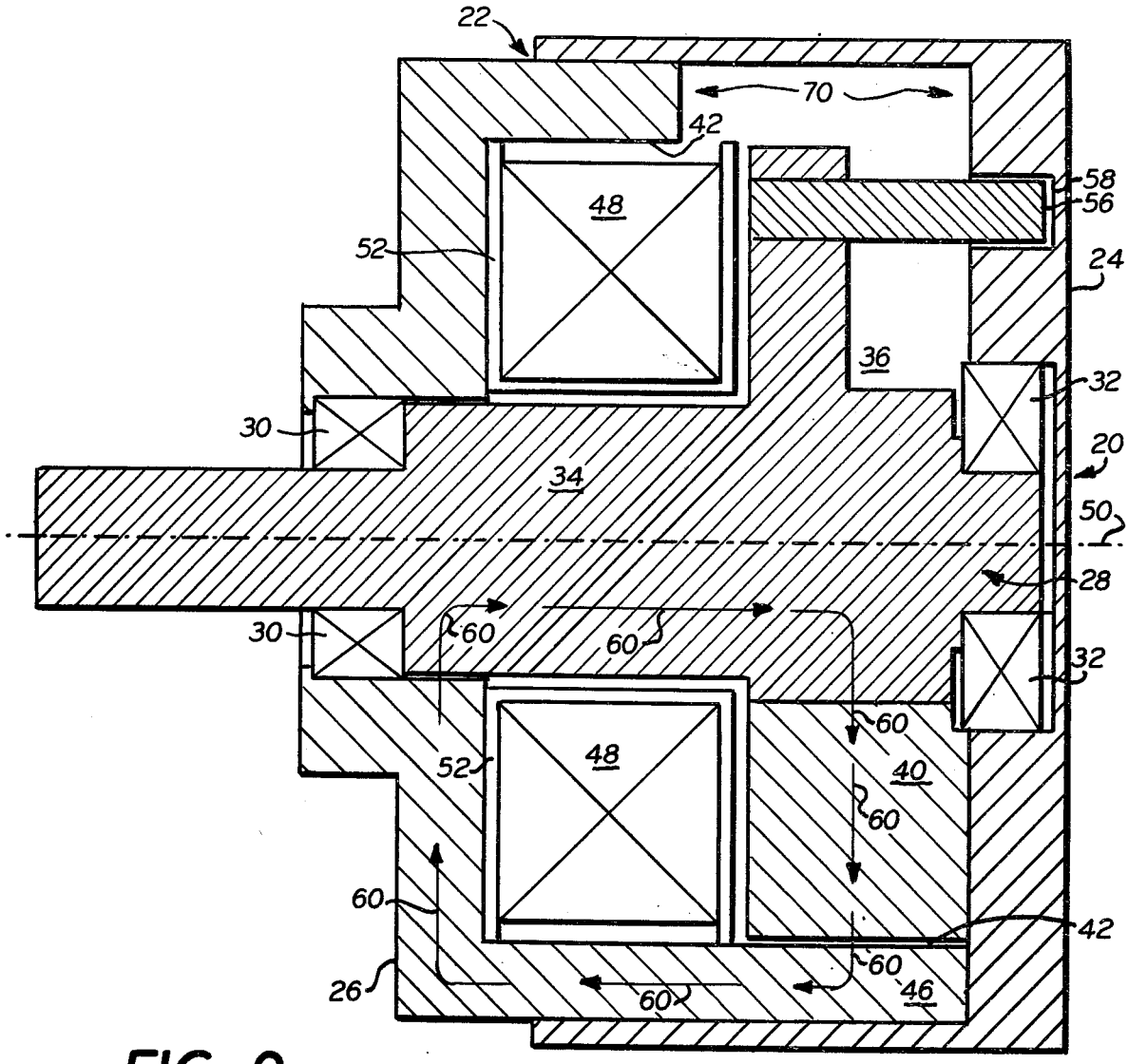
FIG. 2 is a sectional view taken along line 2—2 of FIG. 1 of the embodiment of FIG. 1 showing the cover in position in the rotary solenoid.

Referring to the drawings in detail and initially to FIGS. 1 and 2 thereof, the preferred embodiment of the rotary solenoid of the present invention, generally referred to by the reference numeral 20, is shown. The rotary solenoid 20 preferably comprises a housing portion 22 which, as shown and preferred in FIGS. 1 and 2, preferably comprises a non-magnetic cover portion 24 and a magnetically permeable base portion 26. FIG. 1 is a top plan view of the rotary solenoid 20 with the cover portion 24 of housing 22 removed for purposes of clarity. The rotary solenoid 20 also preferably includes a rotor 28 rotatably mounted in the housing in conventional ball bearings 30 and 32 with ball bearing 30 being located in the base portion 26 of the housing 22 and with ball bearing 32 being located in the cover portion 24 of the housing 22. As shown and preferred, the rotor 28 preferably includes a shaft portion 34 and a disc-like portion 36 from which the shaft portion 34 extends. In addition, preferably the base portion 26 of housing 22 is formed of a magnetically permeable material, such as soft iron or 2-V-Permandur, if desired, or any other magnetically permeable material having the desired flux density characteristics. The rotor 28 is preferably formed of the same magnetically permeable material as the housing 22 base portion 26, however, as will be described in greater detail hereinafter, the disc portion 36 of rotor 28 preferably includes a pair of permanent magnets 38 and 40 mounted therein for simultaneous rotation therewith, with magnets 38 and 40 being substantially diametrically opposed to each other. Preferably, the magnets 38 and 40 have the same magnetic polarity at the outer edge thereof adjacent the interior wall 42 of housing 22, which polarity may provide either north poles or south poles at this position, with north poles preferably being illustrated in FIG. 1. These permanent magnets 38 and 40 are preferably formed of Alnico 8 although any other desired permanent magnetic material could be employed if desired. The base portion 26 of housing 22 is preferably formed with a pair of spaced-apart substantially diametrically opposed upstanding pole pieces 44 and 46 which are formed by providing cut outs in the housing base portion 26 to provide the spaced-apart pole pieces 44 and 46. As also shown and preferred in FIG. 1, the magnets 38 and 40, which are shown in the initial or rest position or static position, preferably slightly overhang the extremities of the respective pole pieces 44 and 46 for magnets 38 and 40, respectively, so as to facilitate the rotation of the rotor 28 in a predetermined direction upon energization of the rotary solenoid 20. Such energization of the solenoid is provided by means of a conventional solenoid coil 48 mounted in the housing 22 about the longitudinal axis 50 thereof. The shaft portion 34 of rotor 28 preferably extends through the solenoid coil 48 which is conventionally mounted on a bobbin 52 along the longitudinal axis 50 and is rotatable within the solenoid coil 48 about the longitudinal axis 50 which serves as the axis of rotation of the rotor 28. As will be described in greater detail hereinafter, when a potential is applied to the coil 48 to place it in the energized state, the rotor 28 is caused to rotate in a predetermined direction, such as illustrated by arrow 54 in FIG. 1 with the rotor 28 rotating in the opposite direction to return to the initial or rest position illustrated in FIG. 1 when the applied potential is removed and the coil 48 is deenergized. As will also be described in greater detail hereinafter, the magnets 38 and 40 preferably have first and second null positions with respect to pole pieces 44 and 46, respectively, with one null position being defined by the centering of the magnets 38 and 40 on the respective pole pieces 44 and 46 and with the other null position being defined by the magnets 38 and 40 being centered in the spaces provided between the pole pieces 44 and 46 and with the rotor pole pieces 36*a* and 36*b*, which comprise the balance of the disc 36, being centered on the housing pole pieces 44 and 46, respectively.

The rotor 28 also preferably includes an upstanding protrusion or stop pin 56, such as one upstanding from rotor pole piece 36*a* for limiting the angular rotation or travel of rotor 28 about longitudinal axis 50, as will be described in greater detail hereinafter, to insure that the magnets 38 and 40 cannot be placed into either of the aforementioned null positions. In order to prevent this, stop pin 56 cooperates with an arcuate slot 58 in the cover portion 24 of the housing 22. The stop pin 56 is slidably mounted in slot 58 for movement between the ends 58*a* and 58*b* of slot 58 which ends are selected so as to only enable angular rotation of rotor 28 over a segment sufficient to enable magnets 38 and 40 to rotate about the longitudinal axis 50 between but not equal to the aforementioned null positions. This slot 58 is superimposed by phantom lines in the drawing of FIG. 1 in order to illustrate the above. As stated above, the cover portion 24 of the housing 22 is preferably formed of a non-magnetic material, such as stainless steel or aluminum, whereas the base portion 26 of the housing 22 is preferably formed of the aforementioned magnetically permeable material.

As shown and preferred in FIG. 2, the initial position or static situation flux path for a typical magnet, such as magnet 40, by way of example, is as follows and is illustrated by arrows 60 in FIG. 2. This flux path 60 extends from the magnet 40 to pole piece 46, down through the bottom portion of base portion 26 of housing 22 across a small clearance gap provided between the shaft portion 34 of rotor 28 and the base portion 26 of the housing 22 to the shaft 34, then up the shaft 34 to the disc portion 36 of the rotor 28 and therefrom back to the magnet 40. As previously mentioned, the identical type of flux path is provided for magnet 38, although such magnet 38 is not visible in the view of FIG. 2. It should be noted that magnets 38 and 40 preferably cause a reverse magnetic flux in the magnetically permeable material of the housing 22 and the rotor 28 so that with coil 48 off or deenergized, that is with no potential applied thereto, there is a large reverse magnetic flux, in a direction opposing the flux which would be provided by the coil 48 in the energized state, present in the magnetically permeable housing 22 and rotor 28 portions of the rotary solenoid 20. When the coil 48 is turned on or has potential applied thereto so as to place it in the energized state, the coil 48 provides a magnetic flux opposing the flux of the magnets 38 and 40 and thus forces magnets 38 and 40 away from the respective pole pieces 44 and 46, respectively, out into the air space, only one such air space 70 being illustrated in the view of FIG. 2, between the pole pieces 44 and 46. The rotor pole pieces **36*a* and 36*b*, respectively, then engage the pole pieces 44 and 46, respectively, in the housing 22 in the conventional manner. Thus, the change in magnetic flux through the coil 48 instead of conventionally going from zero to some positive value as it approaches the saturation flux density of the magnetically permeable material chosen for the housing 22 and rotor 28 portions, instead goes from a negative value, such as typically half the saturation flux density or greater, in the initial or static position of the magnets 38 and 40 when the coil 48 is not energized, to a positive value approaching the associated saturation flux density of the aforementioned magnetically permeable material selected. In this manner, there is a greater change in magnetic flux through the coil 48 than possible in conventional rotary solenoids not employing magnets 38 and 40, which magnets 38 and 40 provide or cause a reverse flux in the magnetically permeable material and a consequent greater change in the magnetic flux through this magnetically permeable material. As a result, the effective saturation flux density of the magnetically permeable material is increased to a value beyond the normal associated saturation flux density of the magnetically permeable material chosen, such as by a factor of 50% to 100%, by way of example. Accordingly, by way of example, if 2-V-Permandur were selected as the magnetically permeable material, its effective saturation flux density point or value would be increased from 20,000 gauss to between 30,000 and 40,000 gauss without any increase in size of the housing 22 or, if soft iron were selected as the magnetically permeable material, its effective saturation flux density value or point could be increased from 14,000 gauss to between 21,000 and 28,000 gauss thereby providing the saturation flux density characteristics of 2 V-Permandue for the soft iron. The aforementioned magnets 38 and 40 reverse the magnetic flux in the magnetically permeable material portions of the housing 22 and rotor 28 due to the magnetomotive force of the magnets 38 and 40 being very large compared to the magnetomotive force of the magnetically permeable material at remanence such as on the order of 80 to 1, by way of example, thus preventing the results of normal material aging of the magnetically permeable material from causing the rotor 28 to stick in the actuated position. Thus, the magnetic attraction provided between the magnets 38 and 40 and the respective pole pieces 44 and 46 returns the rotor 28 to the initial or static position when the solenoid 20 is deactuated by removal of the applied potential from the coil 48** placing it in the deenergized state.

As shown and preferred in FIG. 1, the magnets 38 and 40 are preferably slightly offset with respect to each other and with respect to longitudinal axis 50. In addition, as shown and preferred in FIG. 1, each of the magnets 38 and 40 preferably includes a pair of opposed sides **38*a* and 38*b* and 40*a* and 40*b*, respectively, which are substantially normal to the base 38*c* and 40*c*, respectively of the magnets 38 and 40, respectively, with opposed sides 38*a* and 38*b* being connected at the other end by an arcuate surface 38*d* concentric with longitudinal axis 50, as are pole pieces 44 and 46, housing 22 preferably being an annular housing concentric about axis 50 as shown and preferred in FIGS. 1 and 2. Similarly, sides 40*a* and 40*b* of magnet 40 are connected by a similar arcuate surface 40*d* which is concentric with longitudinal axis 50. As further shown and preferred, sides 38*a* and 40*a* of magnets 38 and 40, respectively, are each shorter than their respective opposed sides 38*b* and 40*b*, respectively, so as to provide a different associated flux concentration adjacent side 38*a* from that adjacent side 38*b* and, similarly, a different associated flux concentration adjacent side 40*a* from that adjacent 40*b*, with the lower associated flux concentration being adjacent the smaller sides 38*a* and 40*a*, respectively. It should also be noted that preferably magnets 38 and 40 are symmetrical. This differential in associated flux concentration between the opposed sides of the magnets 38 and 40 increases the return torque as the respective magnets 38 and 40 come to rest at the initial or static position and decreases the initial return torque when the coil 48 is turned off or deenergized. If desired, this difference in associated flux concentration can be achieved in any other manner such as by grinding away a portion of the respective magnets 38 and 40 adjacent one side 38*a* and 40*a*, by way example, thereof. An example of such ground away portion of the magnets 38 and 40 is illustrated by way of example in the sectional view of FIG. 4**.

ALTERNATIVE EMBODIMENTS

Figure 3:
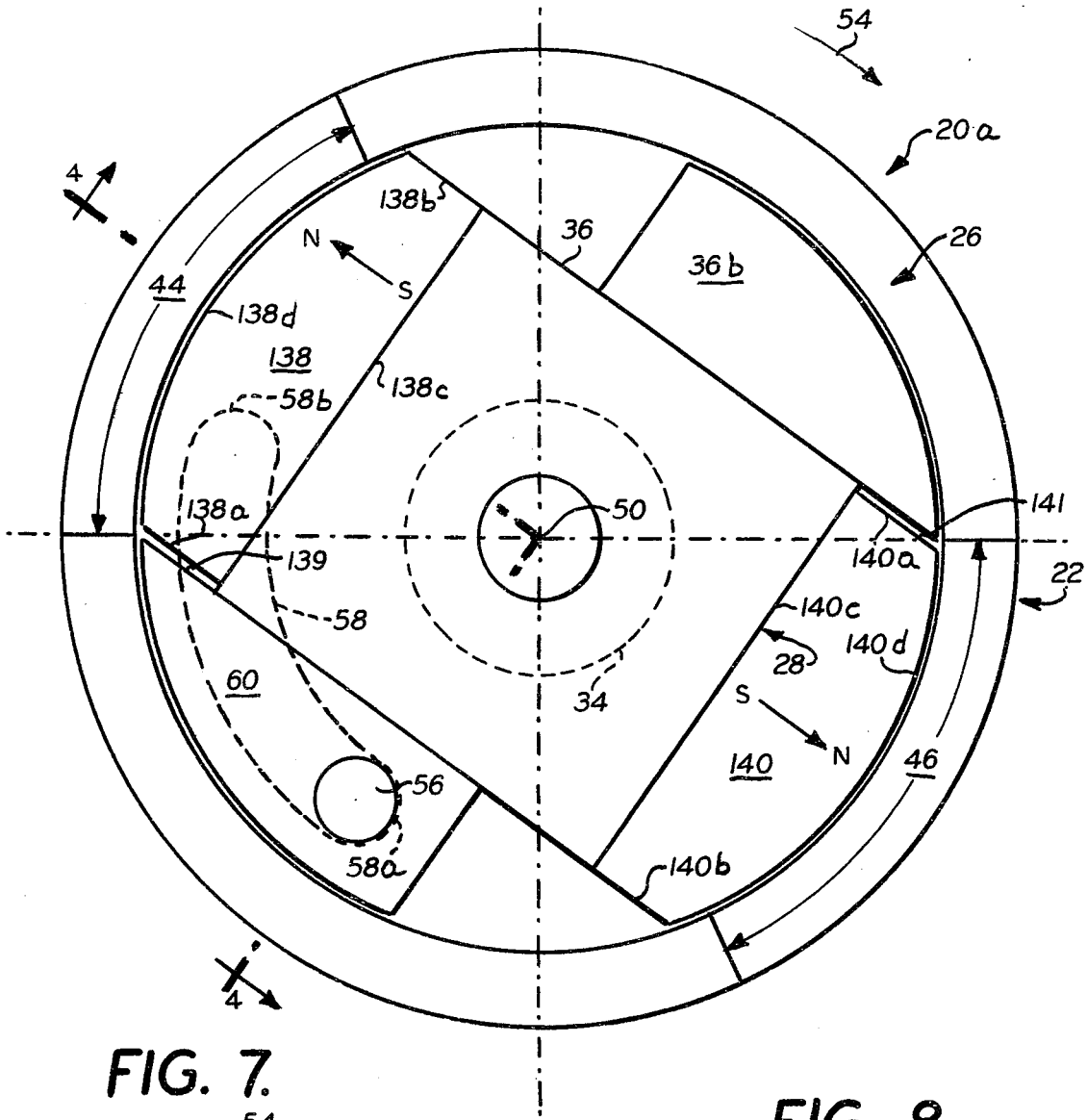
FIG. 3 is a top plan view similar to FIG. 1 of an alternative embodiment of the rotary solenoid of the present invention.
Figure 4:
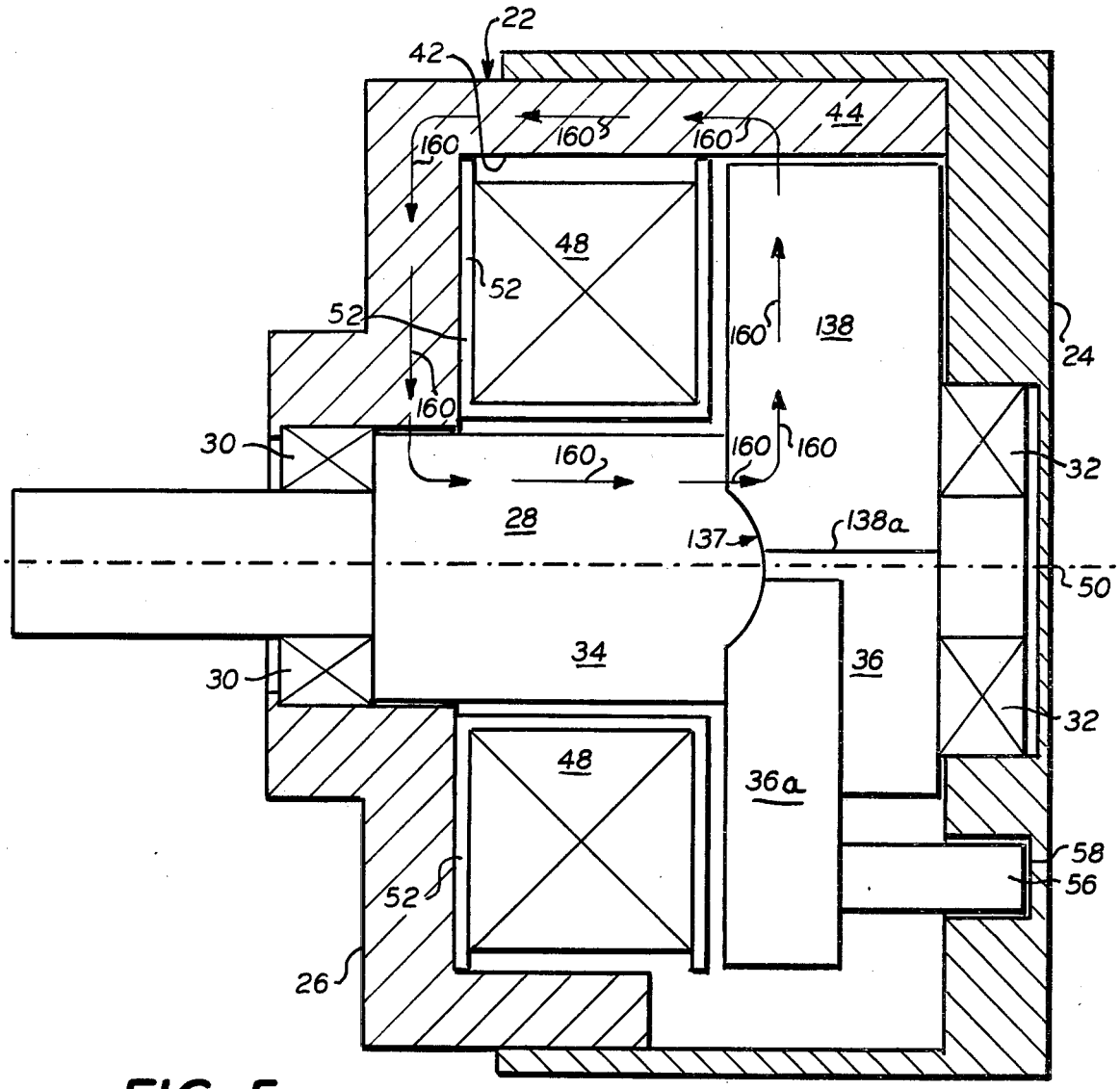
FIG. 4 is a sectional view taken along line 4—4 of FIG. 3 of the alternative embodiment of FIG. 3.

Referring now to FIGS. 3 and 4, an alternative embodiment of the rotary solenoid 20 described with reference to FIGS. 1 and 2 is shown, with the rotary solenoid of FIGS. 3 and 4 generally being referred to by the reference numeral **20*a*. As will be described in greater detail hereinafter, the alternative embodiment 20*a* of the rotary solenoid of the present invention illustrated in FIGS. 3 and 4 is preferably substantially identical to the preferred embodiment 20 of FIGS. 1 and 2 with the exception of the magnets 138 and 140 employed in the rotor 28 of the rotary solenoid 20*a*. Accordingly, identical reference numerals will be employed for identically functioning components in both FIGS. 1 and 2 and FIGS. 3 and 4. With respect to magnets 138 and 140, the purpose of these magnets is preferably identical with the function and purpose of permanent magnets 38 and 40 employed in the preferred embodiment of the rotary solenoid 20 described with reference to FIGS. 1 and 2. The primary difference between magnets 138 and 140, which are mounted in the disc portion 36 of rotor 28 in the rotary solenoid 20*a* illustrated in FIGS. 3 and 4, and magnets 38 and 40 is that magnets 138 and 140 each have the same flux concentration at each of the areas adjacent the opposed pair of sides 138***a* and 138*b* and 140*a* and 140*b*, respectively, magnets 138 and 140 each being substantially symmetrical about a center line therethrough. Thus, sides 138*a* and 138*b* are equal in size and sides 140*a* and 140*b* are equal in size, magnets 138 and 140 also being symmetrical with respect to each other. As with magnets 38 and 40, magnets 138 and 140 are substantially diametrically opposed. In addition, as shown and preferred in FIG. 3, there is a predetermined anti-contact demagnetization gap 139 provided between side 138*a* and rotor pole piece 36*a*, such as a gap of 0.020 inches and an identical anti-contact demagnetization gap 141 provided between side 140*a* and rotor pole piece 36*b*, with the function and purpose of anti-contact demagnetization gaps 139 and 141 being identical to the function and purpose of anti-contact demagnetization gaps 39 and 41 between side 38*a* and rotor pole piece 36*a* and side 40*a* and rotor pole piece 36*b*, respectively, of FIG 1; that is, to prevent contact demagnetization thus keeping the magnets at full strength and preventing flux leakage. As further shown and preferred in FIG. 4, each of the magnets 138 and 140, as well as the rotor pole pieces 36*a* and 36*b* has a ground away portion at the transition point adjacent the trailing side 138*a* and 140*a*, respectively, of the magnet 138 and 140, respectively, in the direction of rotation 54 of the rotor 28 so as to achieve a fuller transition as the coil 48 is operated or energized and deenergized and thereby reduce the peak starting torque and peak return torque of the rotary solenoid 20*a*. Such an arrangement with respect to the rotor pole pieces 36*a* and 36*b* and the magnets 38 and 40 of the preferred embodiment 20 of the rotary solenoid illustrated in FIG. 1 could also preferably be employed. The arrangement illustrated in FIG. 4 also varies the flux concentration in the magnets 138 and 140 so as to provide a different flux concentration at the side, 138*a* and 140*a*, respectively, of the magnet 138 and 140 which has been ground down at portion 137 for example, from the flux concentration present at the opposed side 138*b* and 140*b*, respectively of magnets 138 and 140, respectively, which have not been ground down. Thus, the purpose of the ground down portion 137 of the magnets 138 and 140 is the same as that provided by the difference in side length in the magnets 38 and 40 of the preferred embodiment of FIGS. 1 and 2, namely to increase the return torque as the magnets 38 and 40 come to rest at the initial or static position and decrease the initial return torque when the coil 48 is deenergized. As stated above, the balance of the function and operation of the rotary solenoid 20*a* illustrated in FIGS. 3 and 4 is preferably identical with that of the preferred rotary solenoid 20 of FIGS. 1 and 2 and will not be described in greater detail hereinafter except to say that magnets 138 and 140 preferably function in the same manner with respect to pole pieces 44 and 46, respectively, as do previously described magnets 38 and 40, with magnets 138 and 140 preferably having the identical magnetic polarity with respect to pole pieces 44 and 46 of the housing 22, such magnetic polarity preferably being illustrated by way of example in FIG. 3 as being north adjacent the pole pieces 44 and 46, although, if desired, the polarity could be south, the identity of magnetic polarity of the magnets 38 and 40, and 138 and 140 as mounted in rotor 28 preferably providing a predetermined direction of rotation. It should also be noted that permanent magnets 138 and 140 may preferably be formed of the same material as magnets 38 and 40 such as Alnico 8. It should also be noted that magnets 138 and 140 slightly overhang pole pieces 44 and 46, respectively, in the initial or static position illustrated in FIG. 3 for the same purpose as described with respect to magnets 38 and 40, with rotary solenoid 20*a* operating between the same aforementioned two null positions of the magnets 138 and 140 as described with respect to magnets 38 and 40, and with magnets 138 and 140 causing a reverse flux in the magnetically permeable material portions of the housing 22 and rotor 28, such as described with reference to magnets 38 and 40. In addition, the magnetic flux path in the initial or static position of rotary solenoid 20*a* is preferably identical to magnetic flux path 60 described with reference to FIGS. 1 and 2, with this flux path illustratively being given the reference 160. Apart from the exceptions noted above, the function, operation and construction of the rotary solenoid 20*a* described with reference to FIGS. 3 and 4 is preferably substantially identical with that described with reference to FIGS. 1 and 2 and will not be described in greater detail hereinafter.

Figure 5:
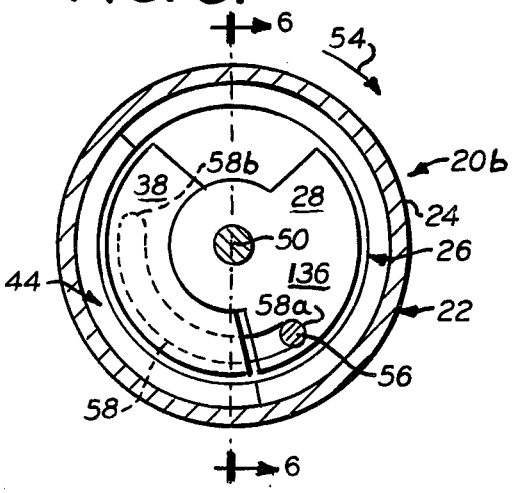
FIG. 5 is a sectional view taken along line 5—5 of FIG. 6 of still another alternative embodiment of the rotary solenoid of the present invention.
Figure 6:
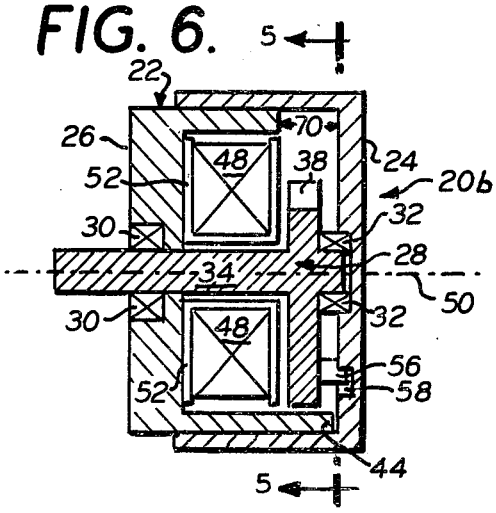
FIG. 6 is sectional view taken along line 6—6 of FIG. 5, similar to FIG. 2, of the alternative embodiment of FIG. 5.

Referring now to FIGS. 5 and 6, another alternative embodiment 20*b* of the rotary solenoid 20 described with reference to FIGS. 1 and 2 is shown. The rotary solenoid 20*b* of FIGS. 5 and 6 is preferably identical in function and operation to rotary solenoid 20 described above with the exception that only a single permanent magnet, such as magnet 38 is preferably mounted in the disc portion 36 of the rotor 28, with only one pole piece 44, by way of example, correspondingly being provided in the housing 22 base portion 26. Thus, this single permanent magnet 38, by way of example, causes rotor 28 to preferably operate or function in the same manner as occurs with respect to the embodiment 20 of FIGS. 1 and 2 in response to the energization and deenergization of the coil 48 as a potential is applied therewith, with magnet 38 preferably slightly overhanging pole piece 44 in the initial or static position of the solenoid 20*b* as illustratively shown in FIG. 5. As stated above, the balance of the construction and operation of the rotary solenoid 20*b* is preferably identical with that previously described with reference to rotary solenoid 20 and will not be described again in greater detail hereinafter, with identical reference numerals with those in FIGS. 1 and 2 being utilized for identically functioning components in rotary solenoids 20*b* and 20*a*. Suffice it so say, that magnet 38 preferably causes a reverse magnetic flux in the magnetically permeable material portions of the housing 22 and rotor 28. It should be noted that rotor 28 in the embodiment of rotary solenoid 20*b* preferably only includes one rotor pole piece 136 preferably identical in function and operation to rotor pole piece 36*a* previously described with reference to FIG. 1.

Figure 9:
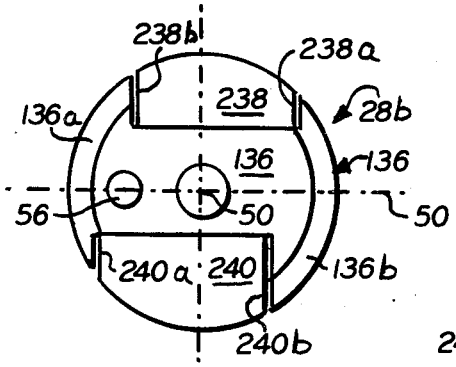
FIGS. 9 through 11 comprise an orthogonal projection of another alternative embodiment of the rotor portion of FIG. 1.
Figure 10:
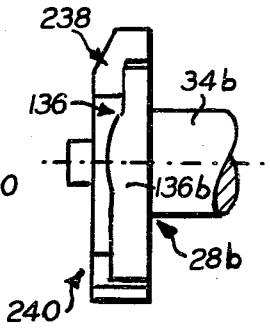
Figure 11:
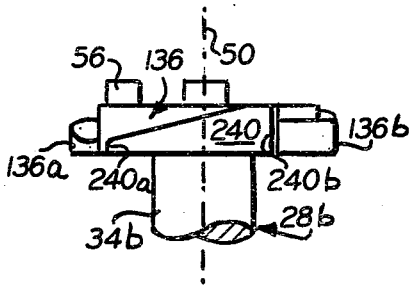

Referring now to FIGS. 9–11, these figures comprise an orthogonal projection of an alternative embodiment of the rotor 28 which may be employed with the housing 22 of the preferred embodiment of FIGS. 1 and 2. This alternative rotor, generally referred to by the reference numeral 28*b* includes a shaft portion 34*b* which is preferably identical with shaft portion 34 previously described with reference to FIGS. 1 and 2 and a disc portion 136, similar in function and operation to disc portion 36 previously described with reference to FIGS. 1 and 2. However, although disc portion 136 contains a pair of spaced apart rotor pole pieces 136*a* and 136*b*, and a pair of substantially diametrically opposed offset permanent magnets 238 and 240, these rotor pole pieces 136a and 136b and magnets 238 and 240 are different in construction from the rotor pole pieces 36a and 36b and the magnets 38 and 40 previously described with reference to FIGS. 1 and 2, although, the function and operation of these rotor pole pieces 136a and 136b and the function and operation of magnets 238 and 240 is preferably substantially identical with the function and operation of rotor pole pieces 36a and 36b, respectively, and magnets 38 and 40, respectively. As shown in the top plan view of FIG. 9, permanent magnets 238 and 240 which are mounted in the disc portion 136 of rotor 28b primarily differ from magnets 38 and 40 in that the upper surface of magnets 238 and 240 are tapered as is clearly shown in FIG. 11. In addition to such tapering, as with magnets 38 and 40, sides 238a and 240a of magnets 238 and 240 are also smaller in size than the respective opposed sides 238b and 240b. This tapering of the upper surface of the magnets 238 and 240 as well as the difference in size or length of sides 238a and 238b, and 240a and 240b, respectively, provides the aforementioned difference in flux concentration and flux over the face of the pole piece of the respective magnets 238 and 240. In addition, as shown in FIGS. 10 and 11, the rotor pole pieces 136a and 136b each have a variable width along their length in order to vary the torque curve of the rotary solenoid on both the forward and return strokes of the solenoid. The variation in width of the rotor pole pieces 136a and 136b is controllably selected to provide any desired torque curve such as linear or sinusoidal, by way of example. As is also shown in FIGS. 9–11, the disc portion 136 of the rotor 28b also contains the aforementioned stop pin 56 which is slidably receivable in a slot 58 of the cover (not shown) in order to control the degree of angular rotation of the rotor 28b to insure that the magnets 238 and 240 do not rotate into either of the aformentioned null positions which were described with reference to magnets 38 and 40. The aforementioned alternative embodiment described with reference to FIGS. 9–11 provides the magnets 238 and 240 with a varying magnetomotive force due to the variation in length of sides 238a and 238b and 240a and 240b, respectively, while the aforementioned tapering of the upper surface of the magnets 238 and 240 adjusts the width of the respective magnets 238 and 240 thus providing a high flux density at that portion of the magnetic pole where the area of the magnet is decreased due to the change in width and a low total flux and, therefore, a low torque at this point. This enables a greater total energy to be developed over the entire closure torque curve of the solenoid than would otherwise be possible without such tapering. In addition, such tapering enables increased length for the magnets 238 and 240 thus facilitating resistance to the demagnetizing effect of the solenoid coil 48 when maximum coil power is applied to the rotary solenoid. Apart from the above, the function and operation of such a rotary solenoid is substantially identical with that previously described with reference to FIGS. 1 and 2 and will not be described in greater detail hereinafter.

Figure 7:
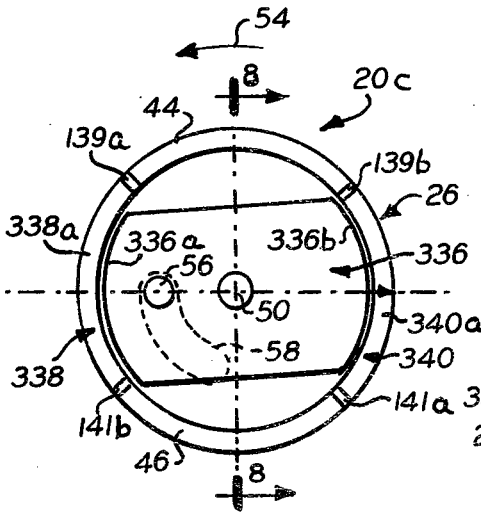
FIG. 7 is a top plan view similar to FIG. 1 of still a further alternative embodiment of the rotary solenoid of the present invention.
Figure 8:
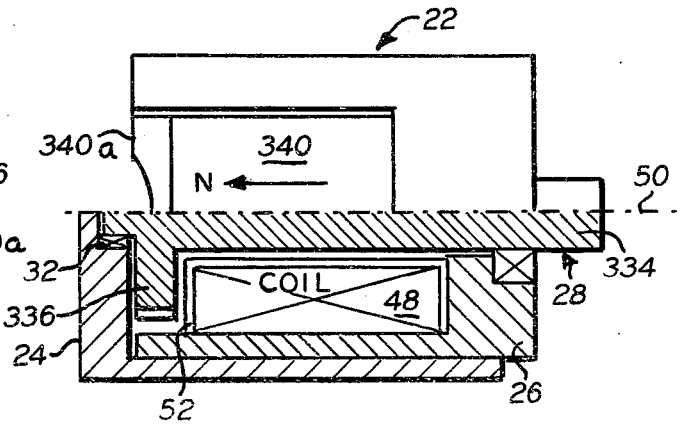
FIG. 8 is a partial sectional view taken along line 8—8 of FIG. 7, with the cover removed, of the alternative embodiment of FIG. 7.

Lastly, referring now to FIGS. 7 and 8, still another alternative embodiment of the rotary solenoid 20 previously described with respect to FIGS. 1 and 2 is shown, with this embodiment generally being referred to by the reference numeral 20c. The rotary solenoid 20c is preferably similar in function and operation to rotary solenoid 20 previously described with reference to FIGS. 1 and 2 with the exception that the location of the permanent magnets and associated pole pieces is reversed, with the permanent magnets 338 and 340 being located in the housing base portion 26, preferably in the spaces, such as space 70, previously existing in the housing of the preferred embodiment between pole pieces 44 and 46. Accordingly, magnets 338 and 340 are substantially diametrically opposed from each other and spaced apart by the housing pole pieces 44 and 46 which are held out of direct contact with magnets 338 and 340 by anti-contact demagnetization gaps 139a and 139b and 141a and 141b which are similar in function and purpose to aforementioned gaps 39 and 41, and 139 and 141 previously described with reference to FIGS. 1 and 3, respectively. Permanent magnets 338 and 340 are preferably formed of the same material as the aforementioned permanent magnets 38 and 40 described with reference to FIGS. 1 and 2 and the housing base portion 26 as well as the rotor 28d is preferably formed of the same magnetically permeable material, such as is described with reference to FIGS. 1 and 2. In the embodiment 20c shown in FIGS. 7 and 8, the rotor 28d differs from rotor 28 in that there are no permanent magnets mounted in the disc portion 336 thereof, shaft portion 334 of rotor 28d preferably being identical with shaft portion 34 of rotor 28. Disc portion 336 includes rotor pole pieces 336a and 336b which are preferably identical in function and operation to previously described rotor pole pieces 36a and 36b of rotory solenoid 20. As further shown and preferred in FIGS. 7 and 8, stop pin 56 which is slidably mounted in slot 58 in the cover portion 24 of the housing 22 performs the same function as previously described to limit the angular rotation of the rotor 28d, thereby preventing the rotor from being located in either of the aforementioned null positions which, in the example of FIGS. 7 and 8 will be either with rotor pole pieces 336a and 336b centered on the respective permanent magnets 338 and 340 or with the rotor pole pieces 336a and 336b being centered on housing pole pieces 44 and 46. As with the embodiments of FIGS. 1 and 2, the rotor pole pieces 336a and 336b are arranged so as to slightly overhang the ends of the respective magnets 338 and 340. Magnets 338 and 340 differ from magnets 38 and 40 in that these magnets 338 and 340, respectively, each preferably have an end cap or pole piece 340a (FIG. 8) or 338a which are preferably formed of a soft magnetically permeable material such as soft iron, by way of example. Furthermore, as shown in FIG. 8, these soft magnetic pole pieces 340a and 338a can also preferably be tapered so as to vary their width, such as was previously described with reference to the upper surface of magnets 238 and 240. The soft magnetic pole pieces 338a and 340a provide higher flux densities than the magnets 338 and 340 so that the effective total return torque present in the rotary solenoid 20c is increased over that which would be present in the absence of the end caps 340a and 338a. In addition, the provision of the end caps 338a and 340a allow the use of anisotropic magnets for magnets 338 and 340. Apart from the above, the function and operation of rotary solenoid 20c is essentially identical with that previously described with reference to rotary solenoid 20 (FIGS. 1 and 2) in that when a potential is applied to coil 48, the coil 48 forms a flux opposing the flux of magnets 338 and 340 and forces rotor pole pieces 336a and 336b away from the magnets 338 and 340 into a position adjacent pole pieces 44 and 46 where the pole pieces 336a and 336b engage pole pieces 44 and 46, respectively, in the conventional manner. With the coil 48 deenergized, magnets 338 and 340 cause a reverse flux in the magnetically permeable material as previously described, with this reverse magnetic flux increasing the effective saturation flux density of the magnetically permeable material utilized for the rotor **28*d* and base portion 26 of the housing 22** as previously described.

Many other alternative embodiments of the rotary solenoid 20 of the present invention may be constructed without departing from the spirit and scope of the present invention such as by combining any of the various alternatives described above or such as by providing any desired plurality of permanent magnets and associated pole pieces dependent on the desired length of stroke, the greater the number of magnets and associated pole pieces provided, the shorter the provided stroke of the rotary solenoid. Moreover, the effective size of the solenoid coil employed in the rotary solenoid of the present invention for a given volume can be greater than that possible with prior art rotary solenoids employing a return spring due to the absence of a return spring and the associated space required therefor in the arrangement of the present invention. Thus, the rotary solenoid of the present invention can be employed in any arrangement in which prior art rotary solenoids are employed such as in driving a camera shutter or a paper drive for a printer, etc., by way of example.

What is claimed is:

1. A rotary solenoid comprising a housing, a rotor rotatably mounted in said housing, said rotor and said housing being comprised of a magnetically permeable material, a solenoid coil mounted in said housing about the longitudinal axis thereof, said rotor having a shaft portion extending through said solenoid coil along said longitudinal axis and being rotatable within said solenoid coil, said housing having a first pole piece portion therein, said rotor further comprising a first permanent magnet means mounted therein for simultaneous rotation therewith, said first permanent magnet means having first and second null positions with respect to said first pole piece and being mounted in the plane of said first pole piece for rotation about said longitudinal axis in said plane between but not equal to said first permanent magnet means null positions, said first permanent magnet means being mounted in said rotor adjacent said first pole piece in a reverse magnetic flux path from said first permanent magnet means extending through said first pole piece, said housing and said rotor for providing a reverse magnetic flux in said housing and rotor magnetically permeable material, said solenoid coil having an energized state and a deenergized state, said rotor rotating a predetermined angular amount about said longitudinal axis from an initial position in response to a predetermined potential applied to said coil in said energized state, said first permanent magnet means causing said rotor to rotate in a direction opposite to said predetermined direction to return said rotor to said initial position when said applied potential is removed from said coil to place said coil in said deenergized state.

2. A rotary solenoid in accordance with claim 1 wherein said magnetically permeable material has an associated saturation flux density, said applied potential being sufficient to provide said saturation flux density in said energized state, whereby a change in magnetic flux through said coil between a predetermined negative flux density value and a predetermined positive flux density value for said magnetically permeable material occurs between said deenergized state and said energized state of said coil thereby increasing the effective saturation flux density of said magnetically permeable material beyond said associated saturation flux density.

3. A rotary solenoid in accordance with claim 1 wherein said rotor further comprises a plurality of substantially equally spaced apart permanent magnet means including said first permanent magnet means all being mounted in said rotor for simultaneous rotation therewith, said housing having a plurality of equally spaced apart pole piece portions therein equal in number to said plurality of permanent magnet means and including said first pole piece portion, said plurality of pole pieces being mounted substantially in a common plane with said plurality of permanent magnet means, said plurality of permanent magnet means having first and second null positions with respect to said plurality of pole pieces and being mounted in said common plane for rotation about said longitudinal axis in said common plane between but not equal to said null positions, said plurality of permanent magnet means providing a reverse magnetic flux in said magnetically permeable material, said plurality of permanent magnet means causing said rotor to rotate in a direction opposite to said predetermined direction to return said rotor to said initial position when said applied potential is removed from said coil to place said coil in said deenergized state, said predetermined angular rotation of said rotor when said coil is in said energized state being dependent on said plurality of permanent magnet means and pole pieces.

4. A rotary solenoid in accordance with claim 3 wherein each of said mounted permanent magnet means has an associated equivalent magnetic polarity with respect to said pole pieces.

5. A rotary solenoid in accordance with claim 1 wherein said housing further has at least a second pole piece portion spaced from said first pole piece portion and substantially diametrically opposed thereto, and said rotor further comprises at least a second permanent magnet means mounted therein for simultaneous rotation therewith and substantially diametrically opposed to said first permanent magnet means, said first and second permanent magnet means having first and second null positions with respect to said first and second pole pieces and being mounted in a common plane with said first and second pole pieces for rotation about said longitudinal axis in said common plane between but not equal to said null positions, said first and second permanent magnet means providing a reverse magnetic flux in said magnetically permeable material and causing said rotor to rotate in a direction opposite to said predetermined direction to return said rotor to said initial position when said applied potential is removed from said coil to place said coil in said deenergized state.

6. A rotary solenoid in accordance with claim 5 wherein each of said mounted permanent magnet means has an associated equivalent magnetic polarity with respect to said pole pieces.

7. A rotary solenoid in accordance with claim 5 wherein said first and second permanent magnet means each have a pair of opposed sides substantially normal to said pole piece when adjacent thereto with one of said sides having an associated flux concentration which differs from an associated flux concentration at the other opposed side of said permanent magnet means, whereby the initial return torque as each of the permanent magnet means comes to rest at said initial position in said deenergized state is increased and said initial return torque when said coil is deenergized is decreased.

8. A rotary solenoid in accordance with claim 5 wherein said first and second permanent magnet means overhang said first and second pole pieces, respectively, in said initial position, whereby said rotor rotation in said predetermined direction in said energized state is facilitated.

9. A rotary solenoid in accordance with claim 5 wherein said housing further comprises a cover portion disposed above said rotor in a plane substantially parallel to said common plane, said cover portion having a slot therein, said rotor having a protrusion extending therefrom into said slot for slidable movement therein, said protrusion being simultaneously rotatable with said rotor and slidable in said slot for providing a stop for said rotor rotation at the end points of said slot, said slot having a predetermined extent between said end points thereof, said extent being the predetermined degree of rotation required for cooperation with said rotor protrusion for confining said rotor rotation about said longitudinal axis to between but not equal to said null position.

10. A rotary solenoid in accordance with claim 5 wherein said rotor further comprises first and second pole pieces, respectively, between said first and second permanent magnet means.

11. A rotary solenoid in accordance with claim 11 wherein the rotor pole pieces each have a varying flux distribution for said rotary solenoid.

12. A rotary solenoid in accordance with claim 1 wherein said first permanent magnet means has a pair of opposed sides substantially normal to said pole piece when adjacent thereto with one of said sides having an associated flux concentration which differs from an associated flux concentration at the other opposed side of said permanent magnet means, whereby the initial return torque as said permanent magnet means comes to rest at said initial position in said deenergized state is increased and said initial return torque when said coil is deenergized is decreased.

13. A rotary solenoid in accordance with claim 1 wherein said first permanent magnet means overhangs said first pole piece in said initial position, whereby said rotor rotation in said predetermined direction in said energized state is facilitated.

14. A rotary solenoid in accordance with claim 1 wherein said housing further comprises a cover portion disposed above said rotor in a plane substantially parallel to said common plane, said cover portion having a slot therein, said rotor having a protrusion extending therefrom into said slot for slidable movement therein, said protrusion being simultaneously rotatable with said rotor and slidable in said slot for providing a stop for said rotor rotation at the end points of said slot, said slot having a predetermined extent between said end points thereof, said extent being the predetermined degree of rotation required for cooperation with said rotor protrusion for confining said rotor rotation about said longitudinal axis to between but not equal to said null positions.

15. A rotary solenoid comprisng a housing, a rotor rotatably mounted in said housing, said rotor and said housing being comprised of a magnetically permeable material, a solenoid coil mounted in said housing about the longitudinal axis thereof, said rotor having a shaft portion extending through said solenoid coil along said longitudinal axis and being rotatable within said solenoid coil, said housing further comprising a first permanent magnet means mounted therein, said rotor having a first pole piece portion therein for simultaneous rotation therewith, said first yole piece having first and second null positions with respect to said first permanent magnet means and being mounted in the plane of said first permanent magnet means for rotation about said longitudinal axis in said plane between but not equal to said first pole piece null positions, said first permanent magnet means being mounted in said rotor adjacent said first pole piece in a reverse magnetic flux path from said first permanent magnet means extending through said first pole piece, said housing and said rotor for providing a reverse magnetic flux in said housing and rotor magnetically permeable material, said solenoid coil having an energized state and a deenergized state, said rotor rotating a predetermined angular amount about said longitudinal axis from an initial position in response to a predetermined potential applied to said coil in said energized state, said first permanent magnet means causing said rotor to rotate in a direction opposite to said predetermined direction to return said rotor to said initial position when said applied potential is removed from said coil to place said coil in said deenergized state.

16. A rotary solenoid in accordance with claim 15 wherein said magnetically permeable material has an associated saturation flux density, said applied potential being sufficient to provide said saturation flux density in said energized state, whereby a change in magnetic flux through said coil between a predetermined negative flux density value and a predetermined positive flux density value for said magnetically permeable material occurs between said deenergized state and said energized state of said coil thereby increasing the effective saturation flux density of said magnetically permeable material beyond said associated saturation flux density.

* * * * *